US007574772B2

(12) United States Patent
Wellman et al.

(10) Patent No.: US 7,574,772 B2
(45) Date of Patent: Aug. 18, 2009

(54) SPRING BALANCE

(76) Inventors: David Anthony Wellman, 112 Walsall Road, Aldridge, West Midlands, WS9 0JW (GB); Peter James Harrison, 29 Margaret Road, Darlaston, West Midlands, WS10 7QT (GB)

( * ) Notice: Subject to any disclaimer, the term of this patent is extended or adjusted under 35 U.S.C. 154(b) by 420 days.

(21) Appl. No.: 11/388,844

(22) Filed: Mar. 24, 2006

(65) Prior Publication Data

US 2007/0220706 A1 Sep. 27, 2007

(51) Int. Cl.
*E05D 13/00* (2006.01)

(52) U.S. Cl. ..... 16/197; 16/193

(58) Field of Classification Search ..... 16/197, 16/193, 201; 49/445, 161, 176, 181; 248/327, 248/323, 325

See application file for complete search history.

(56) References Cited

U.S. PATENT DOCUMENTS

| | | | | | |
|---|---|---|---|---|---|
| 1,226,145 | A | * | 5/1917 | Taylor | 49/149 |
| 1,925,059 | A | * | 8/1933 | Sheard et al. | 49/445 |
| 2,067,164 | A | * | 1/1937 | Smith | 49/429 |
| 2,116,329 | A | * | 5/1938 | Sturman | 16/201 |
| 2,598,560 | A | * | 5/1952 | Kenyon | 16/193 |
| 2,825,089 | A | * | 3/1958 | Algot et al. | 16/197 |
| 3,118,190 | A | * | 1/1964 | Love | 49/174 |
| 3,348,335 | A | * | 10/1967 | Mauro | 49/181 |
| 3,789,549 | A | * | 2/1974 | Yip | 49/181 |
| 5,152,032 | A | * | 10/1992 | Davis et al. | 16/197 |
| 2002/0124349 | A1 | | 9/2002 | Malek et al. | |

FOREIGN PATENT DOCUMENTS

| | | | |
|---|---|---|---|
| GB | 819094 | | 8/1959 |
| GB | 2 262 123 | A | 6/1993 |
| GB | 2 373 813 | A | 10/2002 |
| GB | 2 398 097 | A | 8/2004 |
| JP | 2001055861 | A * | 2/2001 |
| WO | WO 82/01209 | A1 | 4/1982 |

* cited by examiner

*Primary Examiner*—William L. Miller
(74) *Attorney, Agent, or Firm*—Steven J. Hultquist; Intellectual Property/Technology Law

(57) ABSTRACT

This invention relates to a spring balance, and in particular to a spring balance for use with a sliding sash window. The invention provides a spring balance comprising a top assembly which is securable to a frame member, a bottom assembly which is securable to a sliding sash, a tension spring connected to the top assembly and to the bottom assembly, a torsion spring, a spiral rod, and a follower bush interconnecting the spiral rod and the torsion spring. The spring balance is adjustable at the top assembly, and includes a limit mechanism for limiting the range of adjustment, the limit mechanism preventing over-adjustment of the spring balance.

11 Claims, 8 Drawing Sheets

SPRING BALANCE

FIELD OF THE INVENTION

This invention relates to a spring balance, and in particular to a spring balance for use with a sliding sash window.

In the following description, orientational and directional terms such as "vertical", "top", "bottom" etc. refer to the normal orientation of use of the components described (as shown for example in FIG. 3), but the invention places no limitations upon the orientation of the spring balances in use.

BACKGROUND OF THE INVENTION

Sliding sash windows comprising two or more window panels, at least one of which can slide in a vertical direction in use to open and close the window, have been in long term and widespread use. During sliding movement, it is necessary for the user to overcome the frictional resistance to movement caused by engagement of the sliding window panel or sliding sash with the channel in which it moves, and also to support the weight of the sliding sash.

To assist the user in moving the sliding sash, it is known to use a pair of counterweights suspended by respective pulleys within the window frame, one weight to each side of the sliding sash, which counterweights are intended closely to match the weight of the sliding sash. Notwithstanding that the user still has to overcome the frictional resistance to movement, that resistance is often relatively small so that the use of counterweights allows the user more easily to lower (and in particular raise) the sliding sash.

Counterweights have to large extent been replaced by spring balances which utilise one or more springs, and which generate a spring force to seek to counterbalance some or all of the weight of the sliding sash.

Spring balances use a tension spring which is connected at its top to the frame and at its bottom to the sliding sash. Downwards movement of the sliding sash causes the tension spring to extend, providing a return force which will support some or all of the weight of the sliding sash and also assist the user when moving the sliding sash upwardly. However, since the return force provided by a tension spring varies with extension of the spring, a second spring is used so that the resultant return force provided by both springs is more uniform over the range of movement of the sliding sash.

The second spring is typically a helical torsion spring which is held at one end and with the "free" end being forced to rotate as the sliding sash is moved. Rotation of the free end of the torsion spring is usually effected by a spiral rod which is connected to the sliding sash and which is caused to move through a follower bush carried by the free end of the torsion spring, the follower bush converting the relative axial movement of the spiral rod into rotation of the free end of the torsion spring. Such a spring balance is disclosed for example in GB patent 819,094.

The return force can be made more uniform throughout the range of movement of the sliding sash by adjusting the pitch of the spiral rod along its length, i.e. the rate of rotation of the torsion spring can be made dependent upon the extension of the tension spring.

Spring balances are usually adjustable, i.e. the amount of tension in the tension spring and/or the amount of torsion in the torsion spring can be adjusted. This allows the return force provided by the spring balance to be adjusted to match the weight of the particular sliding sash to which it is fitted, and also to ensure that the return force is maintained as desired over the lifetime of the spring balance, during which lifetime the return force provided by the tension spring and/or the torsion spring may reduce. The adjustment is typically effected by varying the preload upon the torsion spring.

The spring balance of GB 819,094, for example, is adjustable by way of rotating the "free" end of the torsion spring, i.e. the bottom end of the torsion spring, relative to the tension spring, by way of the spiral rod. In practice, this requires the bottom of the spring balance to be disconnected from the sliding sash so that the necessary access can be gained to rotate the spiral rod.

Whilst many different types of spring balance are known, employing many different adjustment methods, most require access to be gained to the bottom of the spiral rod, which requires disconnection of the bottom of the spring balance (at least) from the sliding sash, and in some cases requires removal of the entire sliding sash.

When such a spring balance is sold to the window assembler or installer the return force is usually set to its minimum so that the assembler or installer can increase the return force to that necessary to match the weight of the particular window being fitted.

Also, as the return force gradually reduces during the lifetime of the spring balance further adjustment must be effected to increase the return force when required. This adjustment is a specialised task usually requiring specialist assistance i.e. the person requiring adjustment of a fitted spring balance will seldom have the ability or confidence to disconnect or remove the spring balance or sash to effect adjustment, nor have the knowledge of how to adjust the spring balance in any event. Adjustment is made more difficult because both spring balances in each pair must be adjusted together to ensure that the return force is substantially balanced to each side of the window.

The requirement for a specialist to adjust the spring balances during their lifetime is inconvenient at the very least. Also, adjustment of the spring balances during their lifetime and also during initial assembly of the window is a time consuming task since as above indicated the spring balance must usually be disconnected from the sliding sash to effect adjustment, so that the adjustment is often undertaken in several stages, somewhat on a "trial and error" basis, with the spring balance being re-connected after each trial to learn whether the adjustment is correct.

Even if the manufacturer of the spring balances seeks to avoid the need for adjustment during assembly by setting the desired preload for a particular sliding sash, this is not always successful in practice, and it is believed that around 80% of spring balances require adjustment during window assembly, and most spring balances will require subsequent adjustment during their lifetime.

In addition, most spring balances allow adjustment in one direction only, i.e. they employ a ratchet mechanism or the like allowing the return force to be gradually increased, both initially to match the weight of a particular sliding sash to which the spring balance is to be fitted, and also to counteract any reduction in return force over the lifetime of the spring balance. In the event that the spring balance is over-adjusted, i.e. the return force is made too great, it is often necessary completely to dismantle the spring balance in order to reduce the spring force, e.g. to set the return force at its minimum once again.

UK patent application 2,262,123 discloses a spring balance having a tension spring and a torsion spring, in which the adjustment is effected at the bottom, i.e. at the connection to the sliding sash. The return force is increased by way of a ratchet mechanism, and this document discloses means of deactivating the ratchet mechanism if it is necessary or desired to decrease the return force.

UK patent application 2,373,813 discloses a spring balance having a tension spring and a torsion spring, in which adjustment is effected by way of a gearbox connected to the top of the spring balance. The spring balance disclosed in this document has the significant advantage that adjustment can be effected in situ, i.e. without disconnection or removal of the spring balance or the sliding sash. In this spring balance the top of the tension spring is fixed securely to a bracket at the top of the spring balance, which bracket is fixed to the window frame. The bottom of the tension spring carries a block which is connected to the sliding sash and to which the bottom of the torsion spring is also fixed. The top of the torsion spring carries the follower bush through which the spiral rod passes. The top of the spiral rod is fixed to the gearbox at the top of the spring balance. In use, as the spring balance is extended, the bottom of the tension spring is pulled downwardly by way of the block connected to the sliding sash. The torsion spring is also pulled downwardly by the block, and the top of the torsion spring is caused to rotate as the follower bush moves (downwardly) along the spiral rod.

Adjustment of the spring balance of GB 2,373,813 is effected by rotation of the gearbox which causes the top of the spiral rod to rotate, which in turn rotates the top of the torsion spring. Since the bottom of the torsion spring cannot rotate this adjustment affects the preload of the torsion spring and thus the return force of the spring balance.

Whilst the disclosure of GB 2,373,813 avoids the major drawbacks of those spring balances which are adjustable at the bottom, the disclosed spring balance has a significant disadvantage. Specifically, adjustment is effected by rotation of a gear which has a hexagonal head and which is located in a hexagonal opening in the gearbox housing. To effect adjustment the hexagonal head must first be pressed inwardly (against the force of a biasing spring), usefully by a screwdriver, to release the hexagonal head from the hexagonal opening, whereupon the gear can be rotated as desired. However, when the adjustment has been completed the hexagonal head must be aligned with the hexagonal opening before the screwdriver is removed, so that the gear is prevented from rotating. In practice this is very difficult to achieve because the hexagonal head is necessarily a close fit in the hexagonal opening; if the screwdriver is removed with the hexagonal head not engaging the hexagonal opening the torsion spring will rotate freely so as to remove any preload therein. The desired preload must then be reintroduced. Clearly, it will often be necessary to remove all of the preload in the other, unaffected, spring balance at the other side of the window, so that the two spring balances can be adjusted together, and importantly by the same amount.

The difficulty in achieving satisfactory operation is exacerbated by the requirement to push in the screwdriver against the bias of the return spring, and therefore to reduce the pressure upon the screwdriver as this is removed, in order to allow the return spring to force the hexagonal head of the gear towards (and hopefully into) the hexagonal opening. Clearly, as the pressure on the screwdriver is reduced the tendency of the gear to rotate under the influence of the torsion spring is considerable, and even slight misalignment of the hexagonal head will allow the screwdriver to be removed without the head engaging the hexagonal opening, with the consequent free rotation of the torsion spring.

Accordingly, whilst the arrangement of GB 2,373,813 appears simple in using the same gear both to adjust the preload and also to prevent free rotation of the torsion spring, in practice this presents significant difficulties.

Another significant disadvantage of the spring balance of GB 2,373,813 (and which is shared by many prior art spring balances) is that there is no upper limit upon the preload which can be set. It is therefore widely recognised that the spring balances can be over-adjusted. Slight over-adjustment is not too great a concern, though any over-adjustment increases the strain upon the torsion spring (and other components) unnecessarily, leading to a reduction in the useful life of the spring balance. However, significant over-adjustment is a widely-recognised concern, and this can damage a spring balance by exceeding the tolerance either of the torsion spring or other componentry within the spring balance. Typically, significant over-adjustment manifests itself in damage to the follower bush, which is either forcibly separated from the torsion spring, or else damaged so that it rotates freely upon the spiral rod. In both cases the effect of the torsion spring is lost and the spring balance must be extensively repaired or replaced.

SUMMARY OF THE INVENTION

The inventors have realised that there is a need for a spring balance which overcomes or reduces the above-stated disadvantages.

According to the first aspect of the invention, therefore, there is provided a spring balance comprising a top assembly which is securable to a frame member, a bottom assembly which is securable to a sliding sash, a tension spring connected to the top assembly and to the bottom assembly, a torsion spring, a spiral rod, and a follower bush interconnecting the spiral rod and the torsion spring, the spring balance being adjustable by way of a gearbox within the top assembly, the gearbox having a ratchet mechanism and an over-ride mechanism, the ratchet mechanism permitting adjustment of the spring balance to increase the preload, and the over-ride mechanism allowing the ratchet mechanism to be disabled and allow a reduction in the preload.

As above indicated, the spring balance will usually be supplied to the installer with the preload set at its minimum (i.e. with substantially no torsion in the torsion spring). During assembly (and/or installation) of the window the preload can be increased as desired. If, however, the preload is increased too much, the over-ride mechanism can be operated and the ratchet mechanism disabled allowing the preload to be reduced as desired.

It is a particular benefit of a ratchet mechanism that the amount of adjustment can be readily measured, i.e. the number of "clicks" of the ratchet mechanism can be counted and it can be ensured that the adjustment of both spring balances of each window are matched.

Preferably, the ratchet mechanism comprises a spring-biased plunger which can engage in a number of recesses in a gear of the gearbox. The plunger and the recesses have tapered engagement surfaces and the recesses are preferably in the form of saw teeth. Preferably also, the over-ride mechanism comprises a peg connected to the plunger and by which the plunger can be moved to release the plunger from the respective recess.

According to the second aspect of the invention, there is provided a spring balance comprising a top assembly which is securable to a frame member, a bottom assembly which is securable to a sliding sash, a tension spring connected to the top assembly and to the bottom assembly, a torsion spring, a spiral rod, and a follower bush interconnecting the spiral rod and the torsion spring, the spring balance being adjustable by way of a gearbox within the top assembly, the gearbox having a limit mechanism for limiting the maximum preload.

Preferably, the limit mechanism is a threaded member threadedly mounted to a gear of the gearbox, the threaded member moving axially as the gear rotates. Preferably also the threaded member engages a part of the gearbox housing to limit its axial movement, and therefore limit the rotation of the gear.

By varying the pitch of the threads upon the threaded member, and by varying the axial movement available to the threaded member, the rotation of the gear can be limited as desired. Typically, the torsion spring can accommodate a certain number (e.g. fifteen) rotations as adjustment (in addition to the rotations undergone during movement of the window), and it can readily be arranged that the limit mechanism can allow only that number of rotations during adjustment.

Desirably, the torsion spring is connected to the top assembly and the spiral rod is connected to the bottom assembly, and the gearbox is connected directly to the torsion spring. Accordingly, the preload of the spring balance is adjusted by way of a direct connection between the gearbox and the torsion spring, and not indirectly by way of the spiral rod (as in GB 2,373,813).

Preferably, the bottom assembly includes a pivoting mounting for the sliding sash, and a braking mechanism controlled by the pivoting mounting. Desirably, the braking mechanism includes a cam engageable with the walls of the channel within the frame.

Preferably, the bottom assembly includes a mounting bracket for securement to a sliding sash. Preferably also the mounting bracket carries a pivoting stay. Desirably, one end of the pivoting stay is connected to the mounting bracket and the other end of the pivoting stay is connectable to a slide member. In use, the slide member lies within the channel of the frame and moves towards the bottom assembly during pivoting of the sliding sash. Movement of the slide member is limited so as to define the limit of pivoting movement of the sliding sash.

In prior art spring balances in which the adjustment is effected at the bottom assembly, the mounting bracket for the sliding sash would be sold separately to the remainder of the spring balance for assembly on site, since it was necessary to gain access to the bottom assembly for adjustment of the spring balance. Also, the link and the slide member are typically sold loose and assembled to the window as the window is assembled. The requirement for additional assembly is onerous but necessary because of the method of adjustment of these spring balances. The inventors have realised that by providing the adjustment at the top assembly, much or perhaps all of the componentry of the spring balance can be pre-assembled so reducing the number of separate components supplied to the window assembler and requiring assembly with the window. Thus, the mounting bracket for the sliding sash and the stay can be pre-assembled with the remainder of the spring balance. In some embodiments the slide member can also be pre-assembled, so that all of the components of the spring assembly are pre-assembled and sold together as a single unit for installation by the window assembler. This has clear benefits for the window assembler, and also for the spring balance manufacturer who is better able to ensure completeness of the spring balances as sold.

Preferably, the top assembly and the bottom assembly each include two housing parts which are separable. This allows fitment of respective components into one or other of the housing parts before the other housing part is fitted and secured and the components are retained therein.

BRIEF DESCRIPTION OF THE PREFERRED EMBODIMENTS

The invention will now be described in more detail, by way of example, with reference to the accompanying drawings, in which.

DETAILED DESCRIPTION

Figure 1:
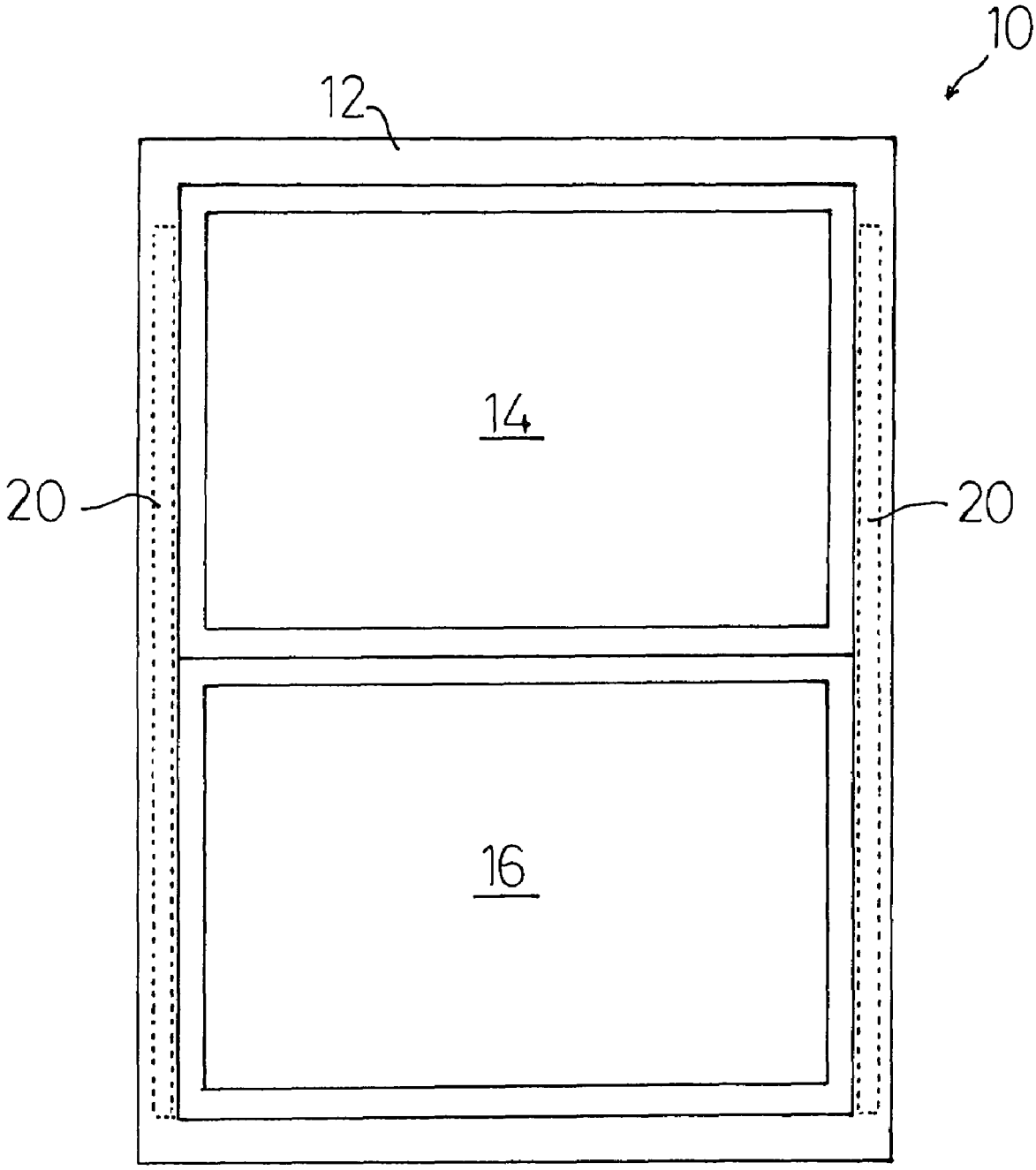
FIG. 1 shows a schematic view of a sliding sash window and its frame.

The window 10 has a frame 12 and two window panels 14, 16. In this embodiment the (bottom) window 16 is a sliding sash and the (top) window 14 is fixed, but it will be understood that in other sliding sash windows the top window 14 could (also or alternatively) be a sliding sash.

The frame 12 provides a pair of opposed channels (not shown) within which the sliding sash 16 can slide. A spring balance 20 is located in each of the channels, and each spring balance 20 is connected to the frame 12 and to the sliding sash 16.

It will be understood that when the sliding sash 16 is the bottom window, the spring balances 20 are in their extended positions when the window is closed.

Figure 2:
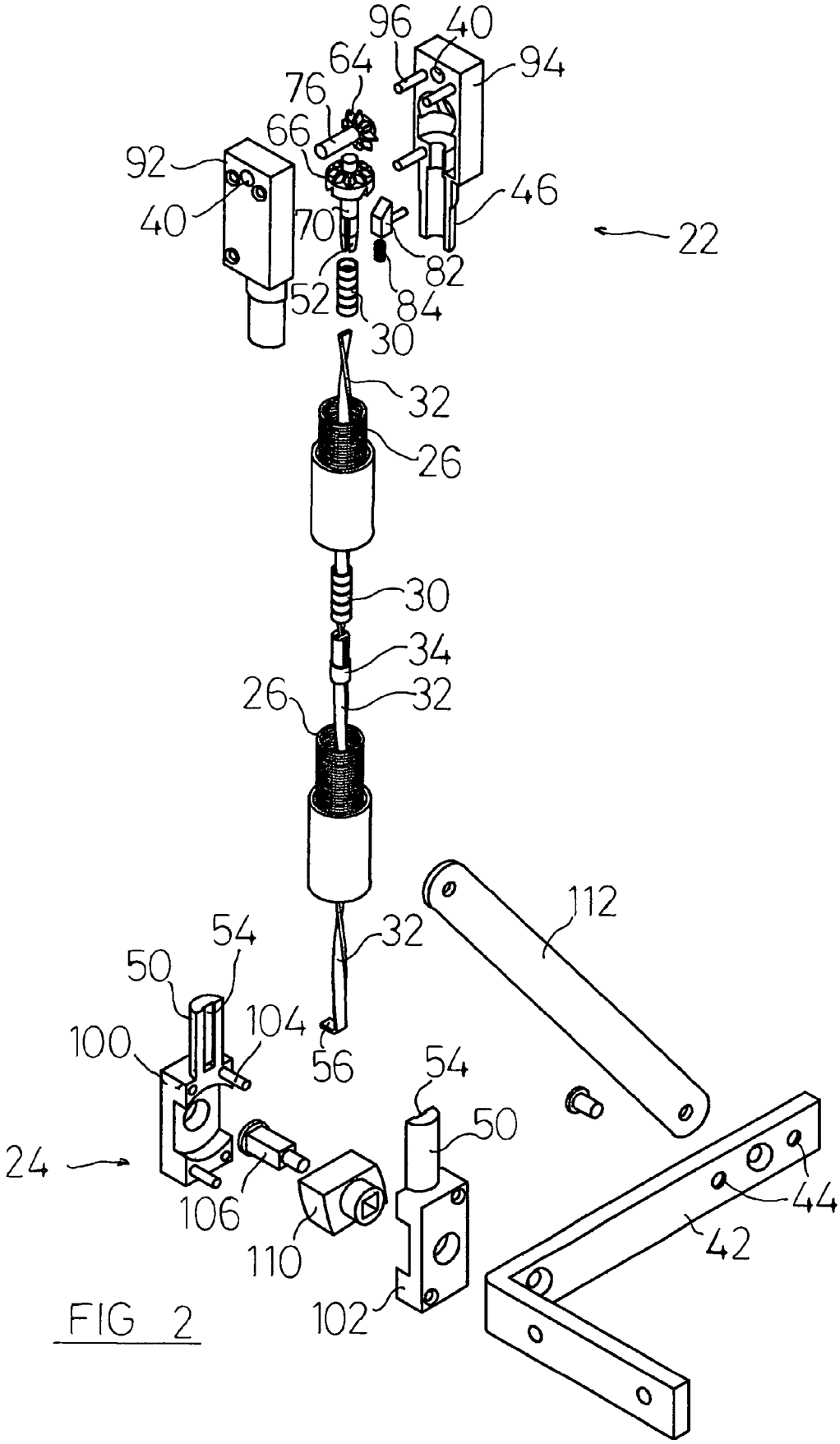
FIG. 2 shows an exploded view of most components of a first embodiment of spring balance according to the invention.

The spring balance 20 is shown in exploded view in FIG. 2, and comprises a top assembly 22, a bottom assembly 24, a tension spring 26, a torsion spring 30 (only parts of the tension spring 26 and torsion spring 30 are shown in FIG. 2), a spiral rod 32 and a follower bush 34.

The top assembly 22 is securable to a part of the frame 12 by way of a screw or other fixing passing through the hole 40. The bottom assembly 24 is securable to the sliding sash 16 by way of a mounting bracket 42 which has holes 44 for receiving screws or other fixings and by means of which the mounting bracket can be secured to the sliding sash 16.

Figure 3:
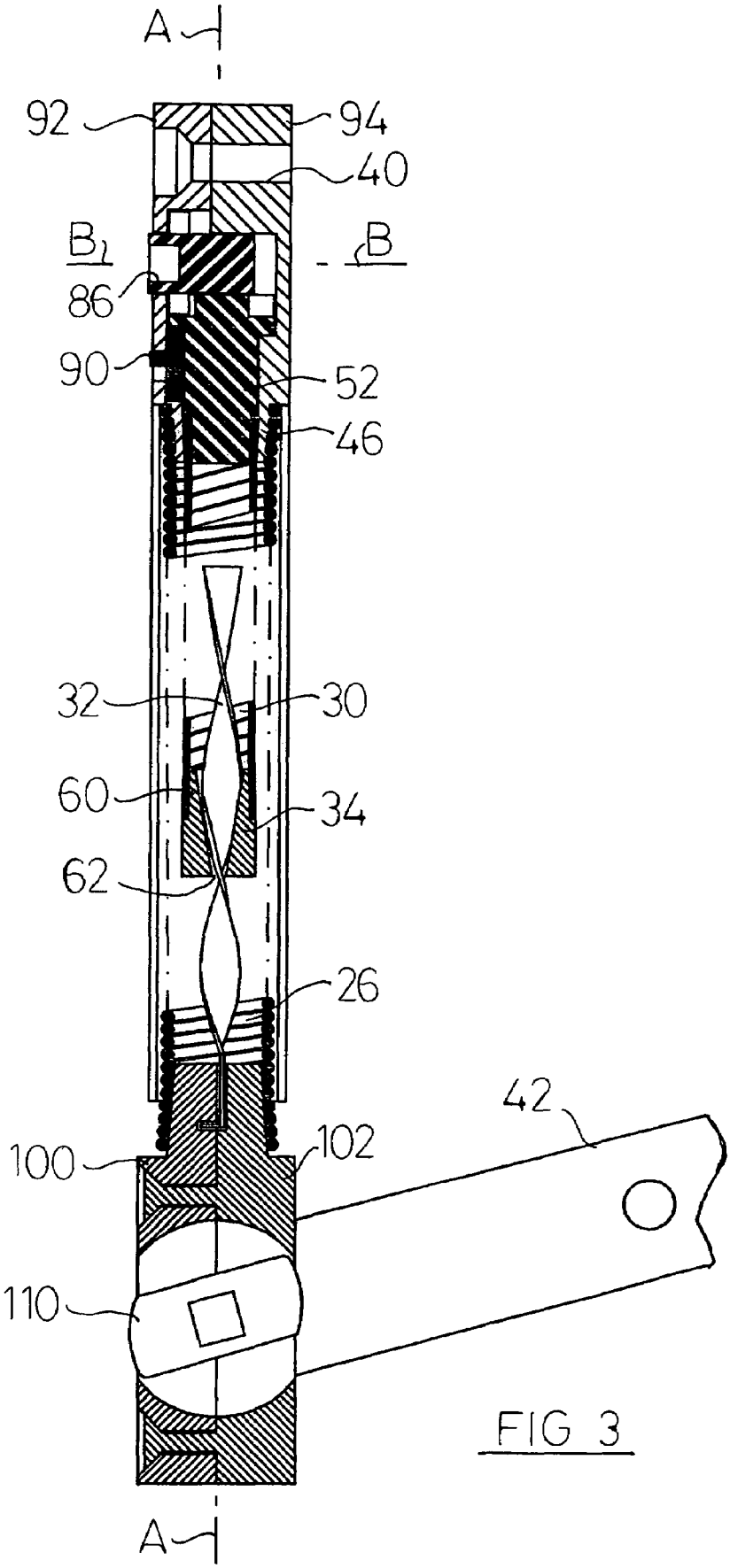
FIG. 3 shows a cross-sectional view of part of the assembled spring balance of FIG. 2.
Figure 4:
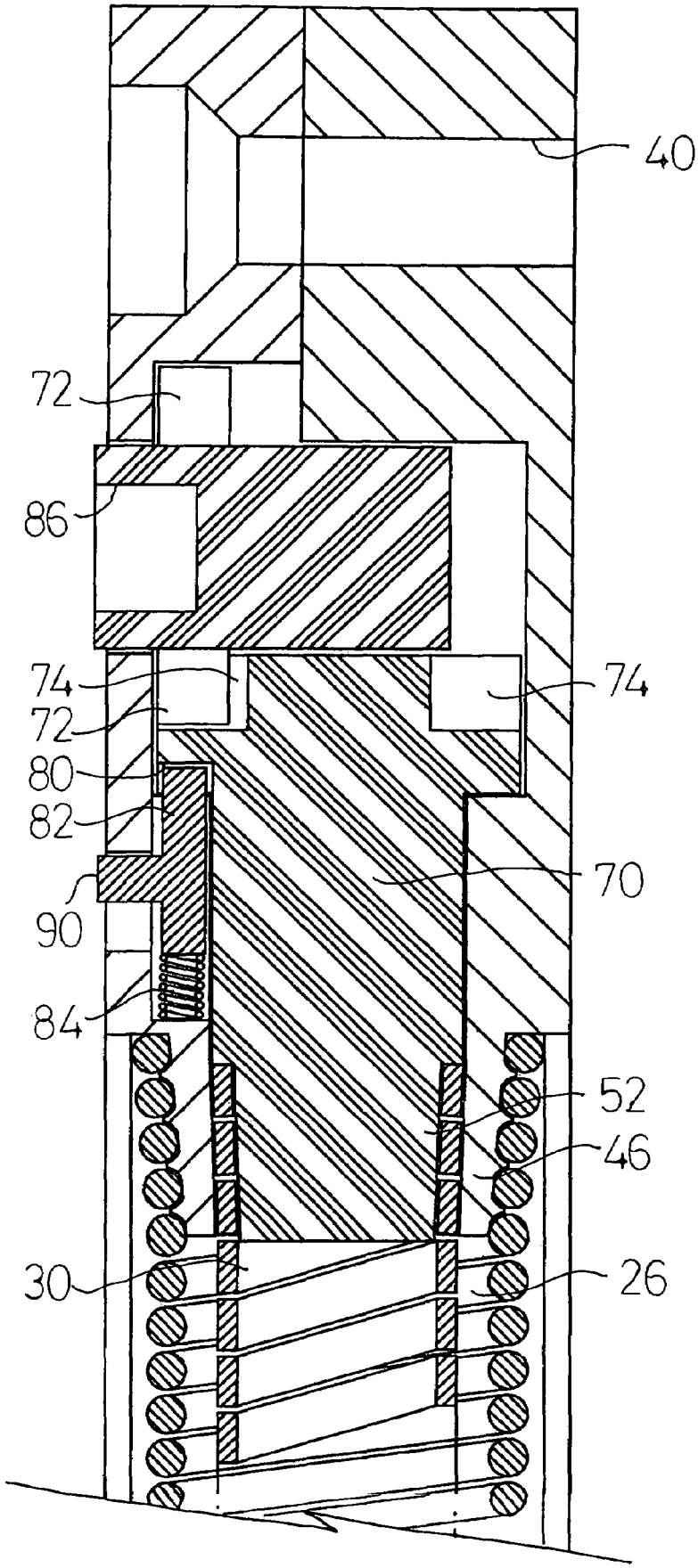
FIG. 4 shows the top part of the cross-sectional view of FIG. 3 in more detail.
Figure 5:
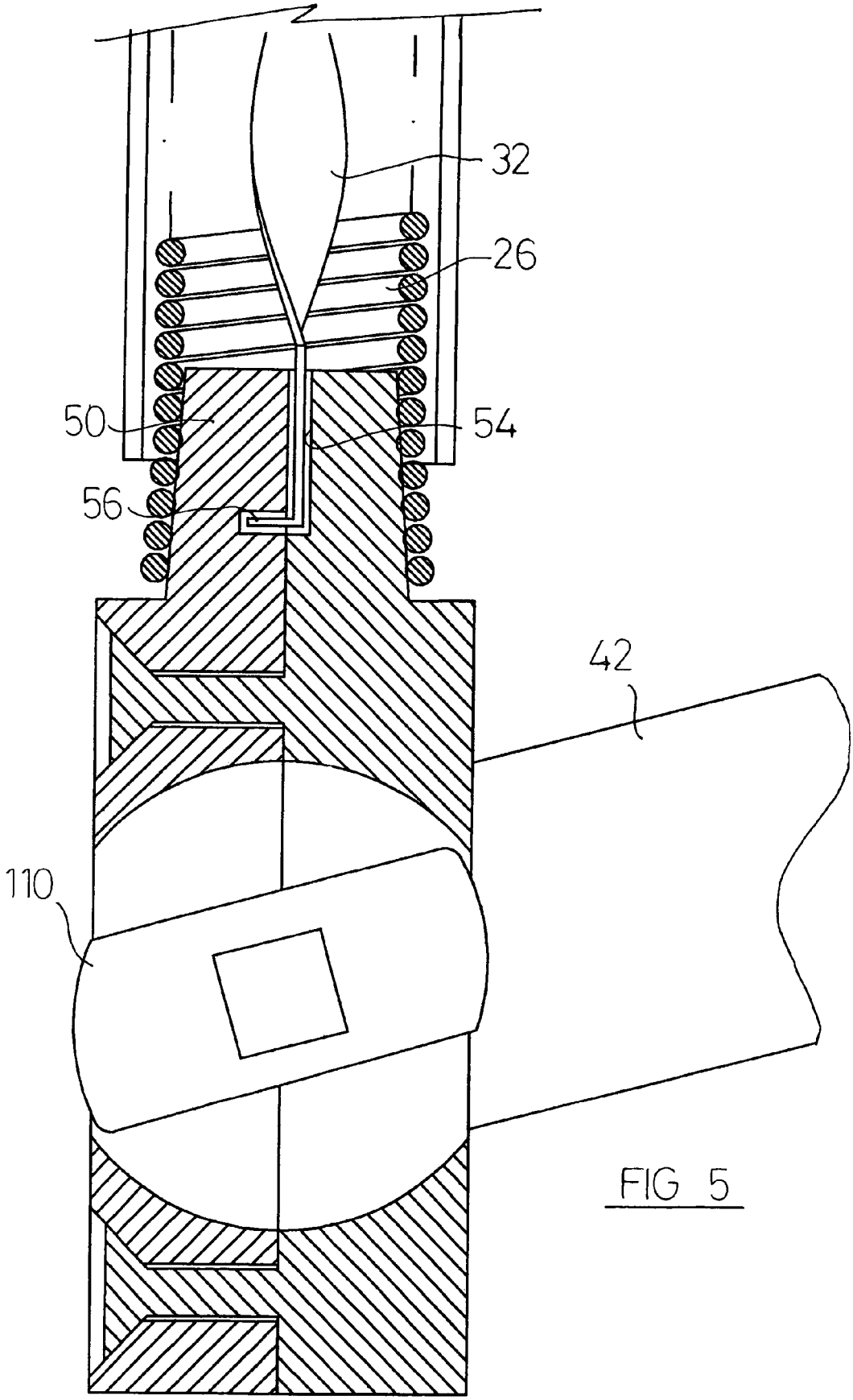
FIG. 5 shows the bottom part of the cross-sectional view of FIG. 3 in more detail.

As better seen in FIGS. 3-5, the tension spring 26 is connected to the top assembly 22 by way of a collar 46, and to the bottom assembly 24 by way of a boss 50. The collar 46 and the boss 50 are preferably slightly tapered and have a terminal diameter significantly greater than the free diameter of the (helically wound) tension spring 26, so that it is necessary to force (or force and rotate) the tension spring 26 onto the collar 46 and boss 50. Thereafter, the resilience of the material of the tension spring 26 will retain the ends of the tension spring in place in the presence of the applied tensile forces.

The torsion spring 30 is connected to the top assembly 22 by way of boss 52 which lies inside the collar 46. The spiral rod 32 is connected to the bottom assembly 24 by way of an opening 54 which receives the "L"-shaped end 56 of the spiral rod 32. The follower bush 34 is connected to the end of the torsion spring 30 by way of a boss 60, the bush having a slot opening 62 formed therethrough and through which is passed the spiral rod 32.

The bosses 52 and 60 are preferably slightly tapered and have a terminal diameter significantly greater than the free diameter of the (helically wound) torsion spring 30, so that it is necessary to force (or force and rotate) the torsion spring 30 onto the respective bosses 52 and 60. Thereafter, the resilience of the material of the torsion spring 30 will retain the ends of the torsion spring in place in the presence of the applied torsional forces. In addition, and as seen in FIG. 4. the end of the torsion spring is clamped between the boss 52 and the inside of the collar 46.

It will be understood that in common with prior art spring balances, relative axial movement of the follower bush 34 along the spiral rod 32 (as caused by axial movement of the bottom assembly 24 towards or away from the top assembly 22) will result in rotation of the follower bush and consequent rotation of the bottom end of the torsion spring 30. Since the top end of the torsion spring 30 is held by the boss 52, rotation of the follower bush 34 acts to add or remove potential energy from the torsion spring 30.

According to the present invention, the spring balance 20 is adjustable by way of the top assembly 22, specifically by way of gears 64 and 66. The boss 52 which is connected to the end of the torsion spring 30 is an extension of the gear shaft 70 of the gear 66. The gears 64, 66 have cooperating teeth 72, 74 respectively and operate to drive the gear shaft 70 of the gear 66 about an axis parallel to (and in this embodiment coincident with) the longitudinal axis A-A of the spring balance 20, whilst the gear shaft 76 of the gear 64 rotates about an axis B-B which is substantially perpendicular to the axis A-A.

The gear 66 also has a number of detent notches 80 which are engageable by a latch 82, the latch 82 being biased by compression spring 84 into engagement with a detent notch 80. The form of the detent notches 80 and latch 82, and the presence of the compression spring 84, provide a ratchet mechanism which resists movement of the gear 66 in one direction (i.e. clockwise as viewed in FIG. 2), but allows movement in the other direction (i.e. anti-clockwise as viewed in FIG. 2).

The gear 66 in this embodiment has four detent notches 80 which define four retention positions for the ratchet mechanism for each rotation of the gear 66, though there could be more or fewer than four detent notches in other embodiments.

The gear 64 is rotated by way of a screwdriver or the like inserted into its slot 86 (FIGS. 3 and 4). The gear 64 can be rotated anti-clockwise and during this rotation the gear 66 will also rotate, with the latch 82 being driven out of its detent notch 80 (so compressing the compression spring 84), along the underside of the gear 66, and into the next detent notch 80. It is a particular advantage of ratchet mechanisms such as that described that the user will be able to hear and feel the latch 82 entering the detent notches 80 and so can measure the adjustment being made. The user can use the measurement obtained to ensure that the same adjustment is made to the spring balance 20 at the other side of the sliding sash 16.

It will be understood from FIGS. 3 and 4 that the slot 86 in the gear 64 faces in the same direction as the mounting hole 40, and since the mounting hole 40 will necessarily be accessible in the assembled window 10, then so will be the slot 86, allowing adjustment to be made without disconnecting or removing any of the spring balance 20 or the sliding sash 16.

In the event that the spring balance 20 is over-adjusted it is desirable to provide a means for disabling the ratchet mechanism, to permit the user to correct the over-adjustment. In the present invention this is provided by the arm 90 of the latch 82, which arm is movable manually downwardly as viewed to compress the spring 84 and release the latch 82 from its detent notch 80. Clearly, it is desired that a screwdriver or the like is fitted into the slot 86 before the ratchet mechanism is disabled, so that the pre-load in the torsion spring 30 can be released gradually. A user could for example release the ratchet mechanism and rotate the gear 64 through two complete revolutions, before enabling the ratchet mechanism once more and completing the adjustment operation. Such controlled adjustment could easily be replicated for the other spring balance of the sliding sash.

It will be understood that anti-clockwise rotation of the gear 66 as drawn in FIG. 2 will act to increase the pre-load in the torsion spring 30, so that the torsional force exerted by the torsion spring 30 always acts against the ratchet mechanism and the latch 82 and detent notch 80 oppose the force of the torsion spring 30.

The top assembly 22 includes two housing parts 92, 94 which in this embodiment are plastic moldings and which can be secured together by pegs 96. The housing parts 92, 94 define the chambers within which lies the gearbox comprising the gears 64, 66, peg 82 and spring 84. The housing parts 92, 94 also define the boss 52 and the collar 46.

The bottom assembly 24 comprises two housing parts 100, 102 which in this embodiment are plastic moldings and which can be secured together by pegs 104. The housing parts 100, 102 define the chambers within which lie a spindle 106 and a cam 110. The spindle 106 is secured to the mounting bracket 42 so as to pivot therewith during tilting of the sliding sash 16. Thus, it will be understood that the top of the sliding sash 16 can be disconnected from the channel in the frame 12 so that the top of the sliding sash 16 can be tilted (inwardly of the room or building) to allow the user to clean the normally outside surface of the sliding sash 16.

In other embodiments the top assembly and the bottom assembly comprise metallic housing parts, usefully die-castings.

In order to prevent the spring balances 20 from moving the sliding sash 16 after it has been tilted, the spindle 106 rotates as the mounting bracket 42 is tilted, and drives the cam 110 to rotate into clamping engagement with the channel. Thus, as seen in FIG. 5 in particular, when the mounting bracket 42 is tilted the cam 110 is caused to rotate until it projects beyond the periphery of the housing parts 100, 102, and it is arranged that in this position the cam 110 engages the channel and prevents movement of the sliding sash 16 relative to the channel.

Because access to the bottom assembly is not required in use, the mounting bracket 42 can be assembled to the spindle 106 during manufacture of the spring balance, and can therefore be substantially permanently secured thereto.

Also connected to the mounting bracket 42 is one end of a stay 112, which pivots relative to the mounting bracket during tilting of the sliding sash 16. The other end of the stay 112 is connected to a slide member (not shown), which is movably mounted within the channel of the frame 12 and can slide upwardly and downwardly in the channel as the sliding sash is tilted. The slide member can have a limited range of movement to limit the tilting range of the sliding sash. It can be arranged that the stay 112 and the slide member are also assembled to the spring balance 20 during its manufacture, so that the window assembler receives a single component for fitment to a sliding sash window.

Alternatively, however, it may be desired that the slide member is provided separately from the remainder of the spring balance, and be mounted into the channel separately from the spring balance. Even in such embodiments, however, there are only two components supplied to the window assembler, and the window assembler is required only to connect the stay 112 to the slide member, which is far less complicated and time consuming than the assembly required for prior art spring balances.

Figure 6:
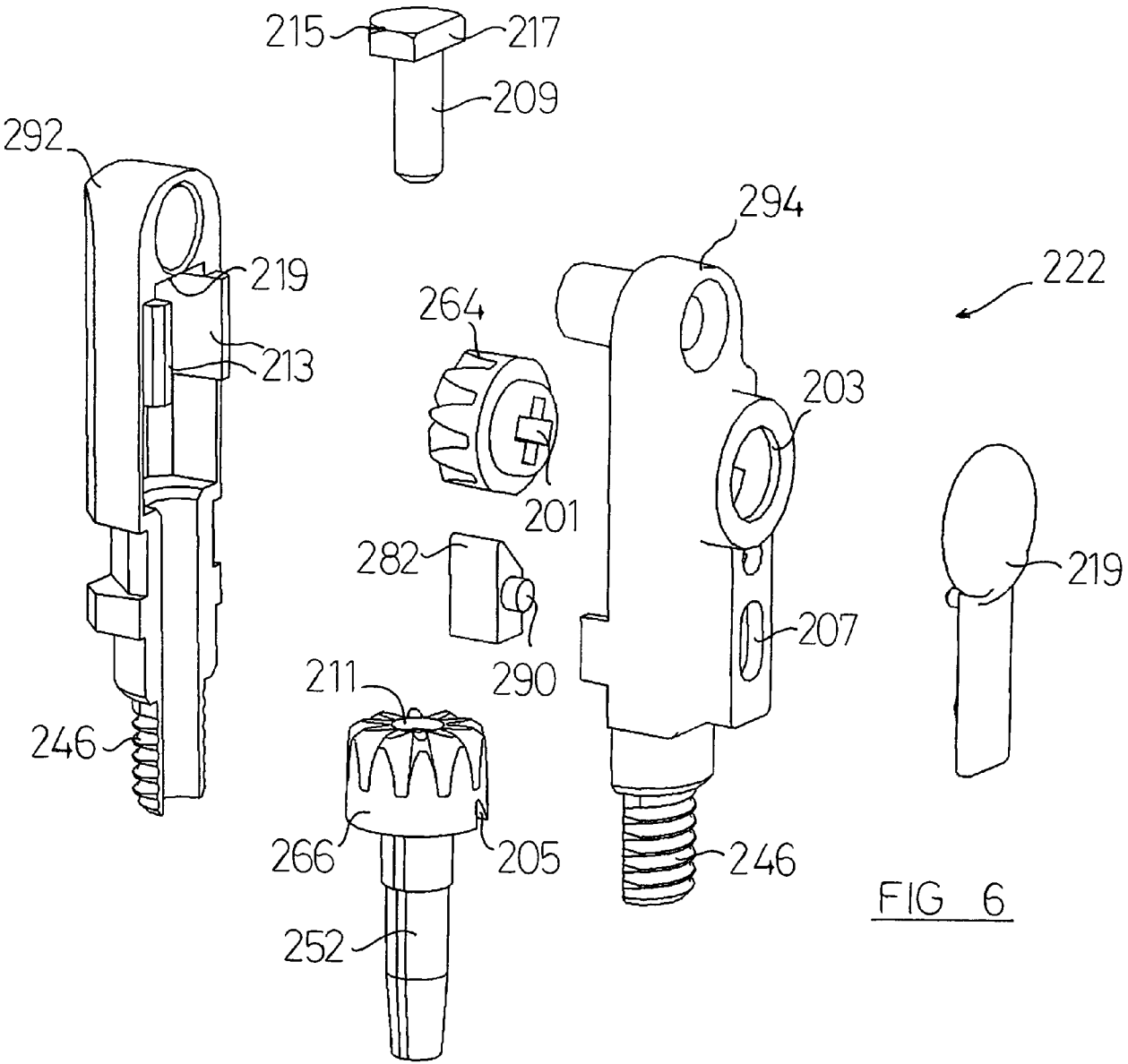
FIG. 6 shows an exploded view of the components of a second embodiment of top assembly.
Figure 7:
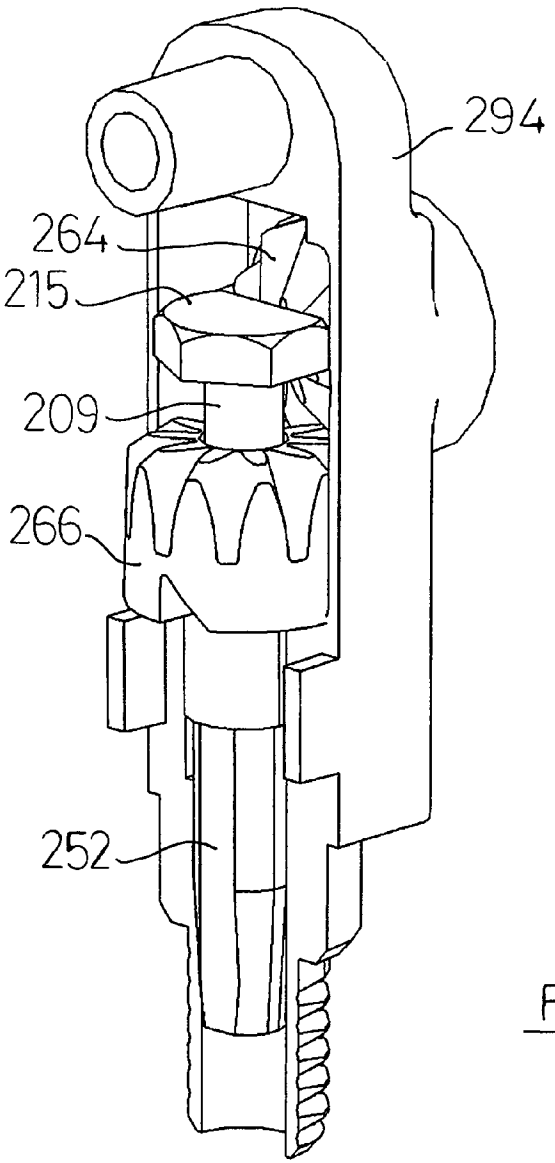
FIG. 7 shows a first view of part of the second embodiment of top assembly, assembled; and, FIG. 8 shows a second view of part of the second embodiment of top assembly, assembled.
Figure 8:
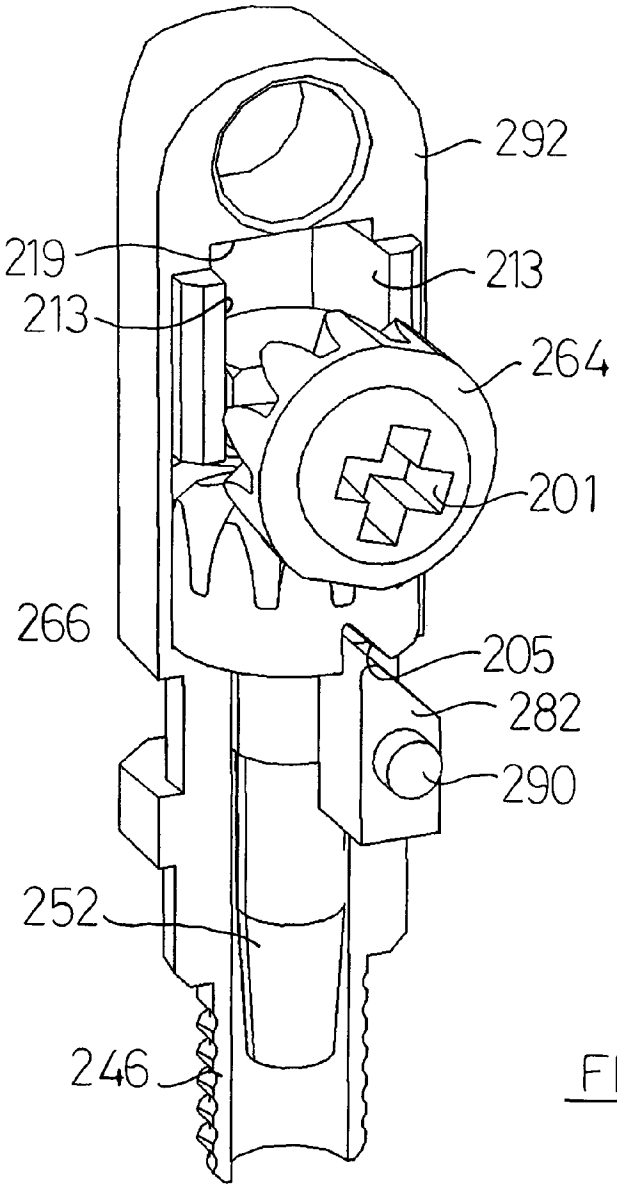

FIGS. 6-8 show the components of a second embodiment of top assembly 222. Whilst only the top assembly 222 is shown in FIGS. 6-8, it will be understood that this top assembly 222 can used with the bottom assembly 24, tension spring 26, torsion spring 30, spiral rod 32 and follower bush 34 of the embodiment of FIGS. 2-5, instead of the top assembly 22 shown in those figures. The embodiment of FIGS. 6-8 include a limit mechanism to limit the available adjustment of the spring balance, and it will be understood that a similar limit mechanism could be incorporated into the top assembly 22 of FIGS. 2-5.

Specifically, the top assembly comprises two housing parts 292 and 294 which together house the other components, and which together provide a collar 246 to receive the top end of a tension spring (not shown) such as 26. The top assembly carries gears 264 and 266 which can cooperate to convert rotation of the gear 264 about a substantially horizontal axis into rotation of the gear 266 about a substantially vertical axis. The gear 266 has a boss 252 which can receive the top end of a torsion spring (not shown) such as 30.

The gear 264 has a recess 201 which can receive a screwdriver or the like, by which rotation may be imparted to the gears 264 and 266 so as to rotate the top end of the torsion spring and adjust the preload in the spring balance. In the assembled top assembly, the recess 201 is accessible through the opening 203 in the housing part 294.

The underside of the gear 266 has a number of recesses 205 which can receive the plunger or latch 282. In this embodiment there are two recesses 205 defining two latched positions for each rotation of the gear 266 (as compared to the embodiment of FIGS. 2-5 which has four recesses defining four latched positions for each rotation of the gear 66). The number of recesses can be determined as desired, with more recesses being more complex but offering greater sensitivity during adjustment. It is understood that most spring balances are adjustable in half-rotations of the end of the torsion spring, so that embodiments with two recesses 205 are presently preferred.

Though not shown in FIG. 6 or 8, and not visible in FIG. 7, a compression spring is provided to bias the plunger 282 upwardly (as drawn) into engagement with the gear 266. It will be noted that the recesses 205 are in the form of saw teeth, and the engaging surface of the plunger 282 is similarly shaped. This ensures that as the gear 266 is rotated in one direction (by way of the gear 264) the plunger 282 is caused to move out of a recess 205, along the bottom of the gear 266 and into the other recess 205, repeatedly. However, movement in the other direction is prevented. The plunger 282 and recesses 205 therefore act as a ratchet mechanism allowing movement of the gear 266 in one direction only (i.e. with the gear 264 being rotated in a clockwise direction as shown in FIG. 8).

It can be arranged that as the plunger 282 enters a recess 205 the ratchet mechanism will issue an audible "click" so that the number of half-rotations of the gear 266 can be readily measured by counting the "clicks", and the same adjustment can be effected on both spring balances of a particular window.

It is arranged that the ratchet mechanism permits rotation of the gear 266 in the direction which increases the preload of the spring balance. If the preload is desired to be reduced, however, the ratchet mechanism can be over-ridden by manual depression of the plunger 282 by way of the arm 290 which projects through the opening 207 in the housing part 294.

To limit the adjustment of the spring balance, the top assembly 222 includes a limit mechanism in the form of a threaded bolt 209 which locates into a threaded bore 211 in the second gear 266. The housing part 292 has two flat surfaces 213 which are spaced by a distance similar to the lateral dimension of the head 215 of the bolt 209, so that the head 215 can slide in an axial direction between the surfaces 213, but the surfaces 213 prevent rotation of the bolt 209.

Part of the bolt head 215 is removed (at 217) to allow the bolt head 215 to pass the first gear 264 (see FIG. 7).

The bolt 209 can move axially within the housing part 292 between an extreme position in which it is fully received in the bore 211 (and the underside of the head 215 engages the top of the gear 266) and another extreme position in which the top of the head 215 engages the surface 219 at the top of the housing part 292.

It will be understood that as the gear 266 is rotated during adjustment, the bolt 209 is caused to move axially up and down depending upon the direction of rotation of the gear 266. The pitch of the threads on the bolt 209 and bore 211, and the length of the chamber within which the bolt 209 can move, are chosen to determine the maximum number of rotations of the gear 266 which are available. Thus, typically the spring balance will be supplied with the minimum preload, and with the bolt 209 at one end of its range of axial movement. Adjustment of the spring balance will both increase the torsion in the torsion spring and cause the bolt 209 to move towards the other end of its range of movement.

Clearly, it will be arranged that the maximum available number of rotations of the torsion spring which are allowed by the limit mechanism are significantly less than could be accommodated by the torsion spring and other components, so that it is not possible to over-adjust the preload to a degree which would damage the spring balance.

The openings 203 and 207 in the housing part 294 are covered in use by an optional cover plate 219.

The invention claimed is:

1. A spring balance comprising a top assembly which is securable to a frame member, a bottom assembly which is securable to a sliding sash, a tension spring connected to the top assembly and to the bottom assembly, a spiral rod connected to one of the top assembly and the bottom assembly, a follower bush mounted upon the spiral rod, and a torsion spring connected to the follower bush and to the other of the top assembly and the bottom assembly, whereby movement of the top assembly relative to the bottom assembly causes movement of the follower bush along the spiral rod and consequent rotation of the follower bush to change torsion in the torsion spring, the spring balance further comprising an adjustment mechanism whereby the torsion in the torsion spring is adjustable, the adjustment mechanism comprising a part of the top assembly, adjustment of the torsion in the torsion spring being effected by way of rotation of said part of the top assembly, the spring balance additionally incorporating a limit mechanism for limiting the rotation of said part of the top assembly and thereby limiting adjustment of the torsion in the torsion spring.

2. A spring balance according to claim 1 wherein the said part of the top assembly is a gear.

3. A spring balance according to claim 2 wherein the limit mechanism limits rotation of the gear to a predetermined amount to prevent over-adjustment of the torsion spring.

4. A spring balance according to claim 1 wherein the torsion spring is connected to the top assembly and the spiral rod is connected to the bottom assembly.

5. A spring balance according to claim 1 wherein the limit mechanism moves during adjustment of the torsion in the torsion spring, and wherein the limit mechanism can engage a stop whereby further adjustment is prevented.

6. A spring balance comprising a top assembly which is securable to a frame member, a bottom assembly which is securable to a sliding sash, a tension spring connected to the top assembly and to the bottom assembly, a spiral rod connected to one of the top assembly and the bottom assembly, a follower bush mounted upon the spiral rod, and a torsion spring connected to the follower bush and to the other of the top assembly and the bottom assembly, whereby movement of the top assembly relative to the bottom assembly causes movement of the follower bush along the spiral rod and consequent rotation of the follower bush to change torsion in the torsion spring, the torsion in the torsion spring being adjustable by way of rotation of a part of the top assembly, the spring balance incorporating a limit mechanism for limiting the rotation of said part of the top assembly and thereby limiting adjustment of the torsion in the torsion spring, wherein the said part of the top assembly is a gear, and wherein the limit mechanism is a threaded member which is in threaded engagement with the gear.

7. A spring balance according to claim 6 wherein the threaded member is substantially non-rotatable so that rotation of the gear causes axial movement of the threaded member, and wherein the threaded member engages parts of the top assembly to limit its axial movement.

8. A spring balance comprising a top assembly which is securable to a frame member, a bottom assembly which is securable to a sliding sash, a tension spring connected to the top assembly and to the bottom assembly, a spiral rod connected to one of the top assembly and the bottom assembly, a follower bush mounted upon the spiral rod, and a torsion spring connected to the follower bush and to the other of the top assembly and the bottom assembly, whereby movement of the top assembly relative to the bottom assembly causes movement of the follower bush along the spiral rod and consequent rotation of the follower bush to change torsion in the torsion spring, the torsion in the torsion spring being adjustable by way of rotation of a part of the top assembly, the spring balance incorporating a limit mechanism for limiting the rotation of said part of the top assembly and thereby limiting adjustment of the torsion in the torsion spring, wherein the top assembly has a ratchet mechanism and an over-ride mechanism, the ratchet mechanism permitting an increase the torsion in the torsion spring, and the over-ride mechanism being adapted to allow the ratchet mechanism to be disabled and allow a reduction in the torsion of the torsion spring.

9. A spring balance comprising a top assembly which is securable to a frame member, a bottom assembly which is securable to a sliding sash, a tension spring connected to the top assembly and to the bottom assembly, a spiral rod connected to one of the top assembly and the bottom assembly, a follower bush mounted upon the spiral rod, and a torsion spring connected to the follower bush and to the other of the top assembly and the bottom assembly, whereby movement of the top assembly relative to the bottom assembly causes movement of the follower bush along the spiral rod and consequent rotation of the follower bush to change torsion in the torsion spring, the torsion in the torsion spring being adjustable by way of rotation of a part of the top assembly, the spring balance incorporating a limit mechanism for limiting the rotation of said part of the top assembly and thereby limiting adjustment of the torsion in the torsion spring, wherein the bottom assembly has a pivoting mounting for the sliding sash, and a braking mechanism controlled by the pivoting mounting.

10. A spring balance according to claim 9 wherein the bottom assembly has a mounting bracket for the sliding sash, the mounting bracket being mounted upon the pivoting mounting.

11. A spring balance comprising a top assembly which is securable to a frame member, a bottom assembly which is securable to a sliding sash, a tension spring connected to the top assembly and to the bottom assembly, a spiral rod connected to one of the top assembly and the bottom assembly, a follower bush mounted upon the spiral rod, and a torsion spring connected to the follower bush and to the other of the top assembly and the bottom assembly, whereby movement of the top assembly relative to the bottom assembly causes movement of the follower bush along the spiral rod and consequent rotation of the follower bush to change torsion in the torsion spring, the torsion in the torsion spring being adjustable by way of rotation of part of a gearbox within the top assembly, the gearbox having a ratchet mechanism and an over-ride mechanism, the ratchet mechanism permitting an increase in the torsion in the torsion spring, and the over-ride mechanism allowing the ratchet mechanism to be disabled whereby to allow a reduction in the torsion in the torsion spring.

* * * * *